US005202734A

United States Patent [19]

Pawlik et al.

[11] Patent Number: 5,202,734

[45] Date of Patent: Apr. 13, 1993

[54] SPRING LOADED OIL DISTRIBUTING PREHEATED DONOR ROLL

[75] Inventors: Robert S. Pawlik, Webster; Richard G. Palmatier, Springwater; Robert Gary, Ontario, all of N.Y.

[73] Assignee: Xerox Corporation, Stamford, Conn.

[21] Appl. No.: 757,089

[22] Filed: Sep. 10, 1991

[51] Int. Cl.[5] ..... G03G 15/20; G03G 21/00

[52] U.S. Cl. ..... 355/284; 118/60

[58] Field of Search ..... 118/60, DIG. 1; 355/284, 283, 282; 219/216

[56] References Cited

U.S. PATENT DOCUMENTS

| | | | |
|---|---|---|---|
| 4,040,383 | 8/1977 | Vandervort | 118/60 |
| 4,045,165 | 8/1977 | Nakajima et al. | 118/60 X |
| 4,214,549 | 7/1980 | Moser | 118/60 |
| 5,049,944 | 9/1991 | De Bolt et al. | 355/284 |

FOREIGN PATENT DOCUMENTS

| | | | |
|---|---|---|---|
| 0100874 | 6/1983 | Japan | 355/284 |
| 0204667 | 9/1986 | Japan | 355/284 |
| 0089979 | 4/1987 | Japan | 355/284 |
| 0164075 | 7/1987 | Japan | 355/284 |
| 0060475 | 3/1988 | Japan | 355/284 |
| 0252986 | 10/1989 | Japan | 355/284 |

*Primary Examiner*—A. T. Grimley
*Assistant Examiner*—Robert Beatty

[57] ABSTRACT

A release agent management (RAM) system including a metering roll supported for contact with release agent material contained in a sump. A donor roll is provided for applying oil deposited on its surface by the metering roll. Prior to fusing taking place, the donor roll is supported in pressure engagement with the fuser roll and out of contact with the metering roll. During fusing the donor roll is cammed into engagement with the metering roll.

12 Claims, 3 Drawing Sheets

SPRING LOADED OIL DISTRIBUTING PREHEATED DONOR ROLL

BACKGROUND OF THE INVENTION

The present invention relates to fuser apparatus for electrostatographic printing machines and, in particular, to release agent management (RAM) systems for a heat and pressure roll fuser.

In imaging systems commonly used today, a charge retentive surface is typically charged to a uniform potential and thereafter exposed to a light source to thereby selectively discharge the charge retentive surface to form a latent electrostatic image thereon. The image may comprise the discharged portions and/or the charged portions of the charge retentive surface, the former in the case of tri-level imaging and the latter in the case of conventional xerography. The light source may comprise any well known device such as a light lens scanning system or a laser beam. Subsequently, the electrostatic latent image on the charge retentive surface is rendered visible by developing the image with developer powder referred to in the art as toner. The most common development systems employ developer which comprises both charged carrier particles and charged toner particles which triboelectrically adhere to the carrier particles. During development, the toner particles are attracted from the carrier particles by the charged pattern of the image areas of the charge retentive surface to form a powder image thereon. This toner image may be subsequently transferred to a support surface such as plain paper to which it may be permanently affixed by heating or by the application of pressure or a combination of both.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer or, for example, tetrafluoroethylene resin sold by E. I. DuPont De Nemours under the trademark Teflon. In these fusing systems, however, since the toner image is tackified by heat it frequently happens that a part of the image carried on the supporting substrate will be retained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem it has been common practice to utilize toner release agents such as silicone oil, in particular, polydimethyl silicone oil, which is applied to the fuser roll surface to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface.

Various systems have been used to deliver release agent fluid to the fuser roll including the use of oil soaked rolls and wicks with and without supply sumps as well as oil impregnated webs. A another type of RAM system is disclosed in U.S. Pat. No. 4,214,549 granted to Rabin Moser on Jul. 29, 1980. As disclosed therein, release agent material is contained in a sump from which it is dispensed using a metering roll and a donor roll, the former of which contacts the release agent material and the latter of which contacts the surface of the heated fuser roll.

A common problem for prior art donor roll RAM systems is the poor distribution of oil within the first several copies. This can occur due to donor roll oil migration and roll slippage as the result of oil puddling. The problem becomes more difficult when dealing with slow process speeds and the high oil rates required for fusing of color images.

BRIEF SUMMARY OF THE INVENTION

Briefly, the present invention comprises a RAM system including a metering roll supported for contact with release agent material or oil contained in a sump and a donor roll which contacts the metering roll and a fuser roll. The oil is conveyed from the sump to the fuser roll via the donor roll.

The donor roll is spring loaded or biased against the fuser roll during the pre run copy mode. At this same time, the donor roll does not contact the metering roll. As the heated fuser roll turns in contact with the donor roll the oil present on the donor roll surface is distributed between the two rolls. Also, during this time, the donor roll temperature becomes elevated thereby limiting the effects of oil viscosity due to temperature. Upon camming of the donor roll into contact with the metering roll the amount of slippage is minimized enalbling a uniformly oiled fuser roll thereby achieving the necessary properties necessary for fusing of color images.

For a better understanding of the present invention, reference may be had to the accompanying drawings wherein the same reference numerals have been applied to like parts and wherein:

DESCRIPTION OF THE PREFERRED EMBODIMENT

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Figure 1:
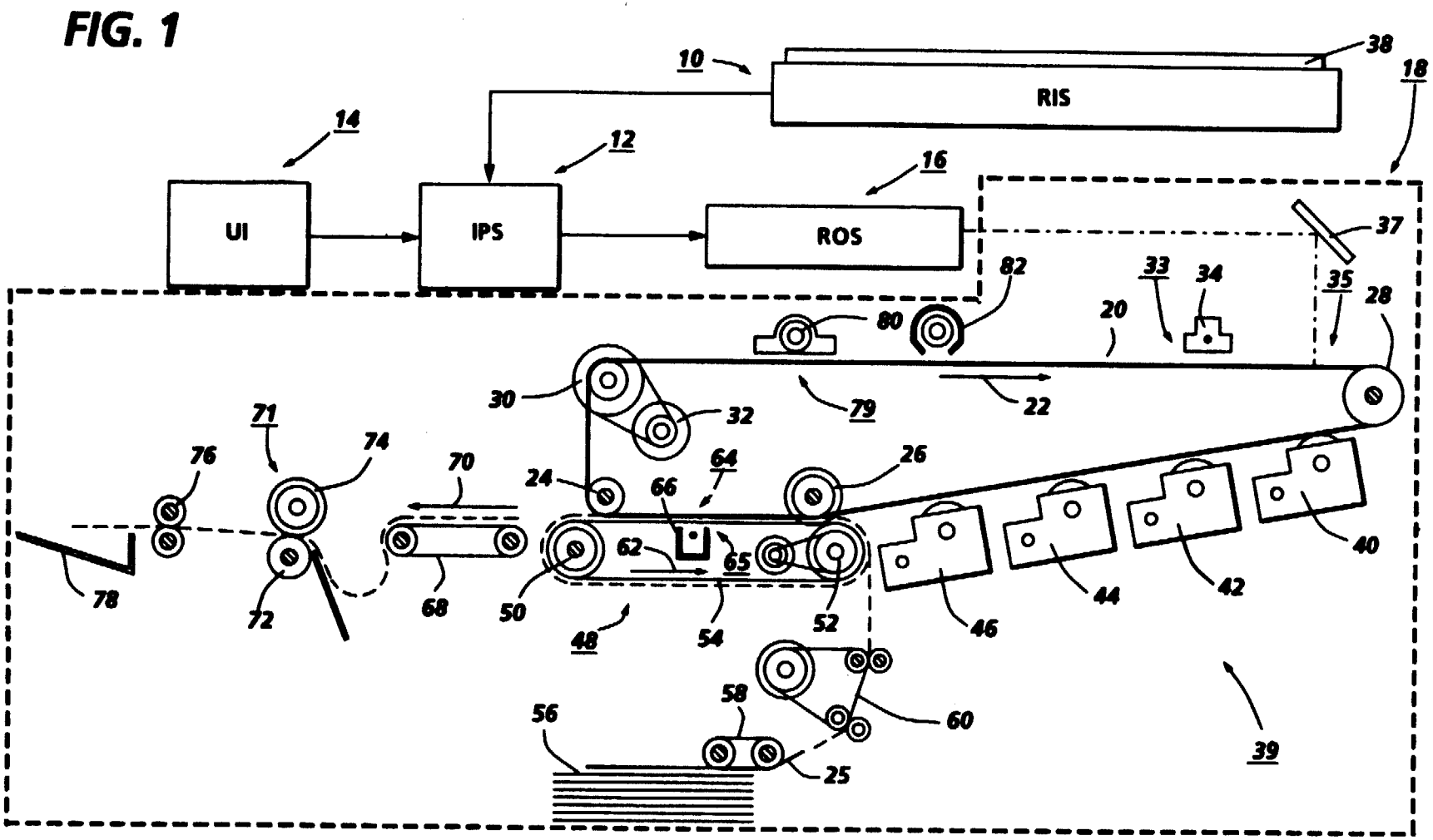
FIG. 1 is a schematic illustration of an imaging apparatus suitable for use of the present invention.

For a general understanding of the features of the present invention, reference is made to the drawings. In the drawings, like references have been used throughout to designate identical elements. FIG. 1 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchroism with the movement of sheet gripper, not shown. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
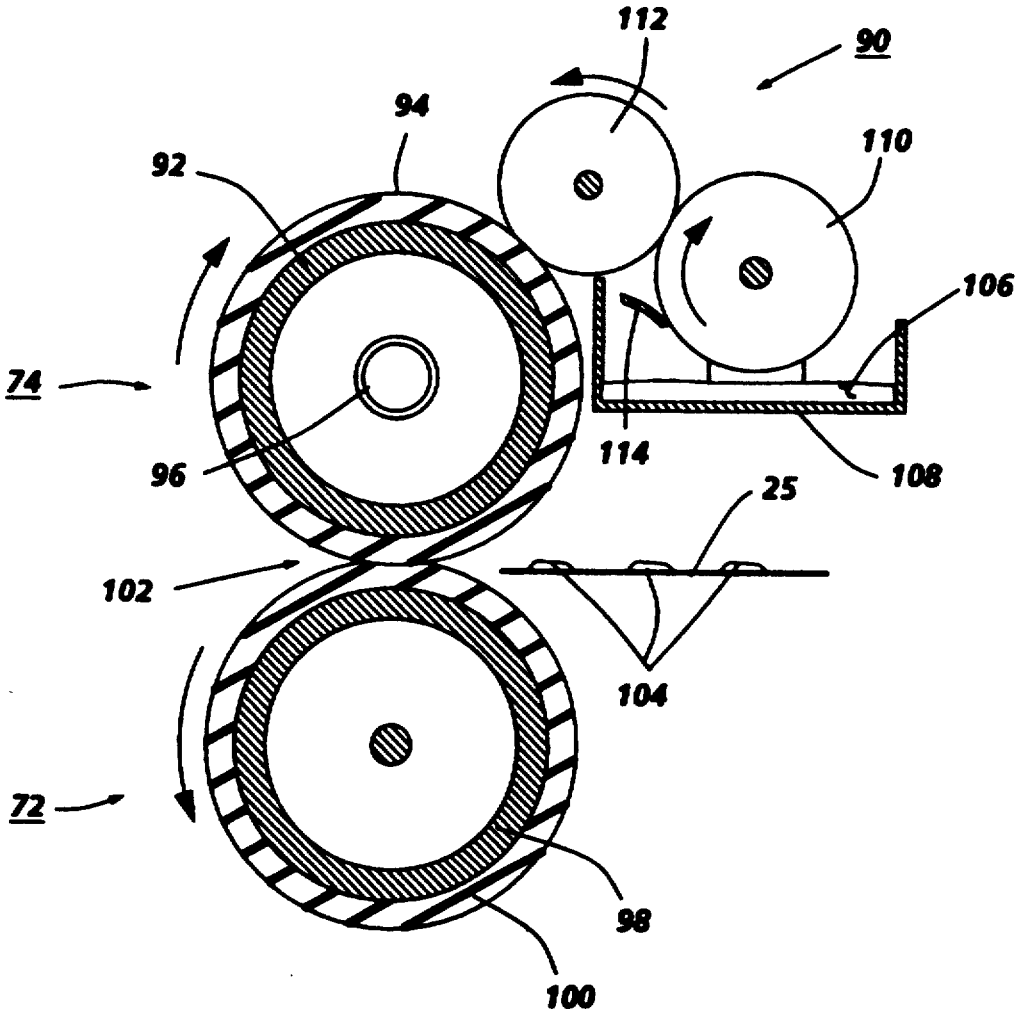
FIG. 2 is a schematic representation of a roll fuser and a release agent management (RAM) system in which the present invention is incorporated.

Attention is now directed to FIG. 2 wherein the heat and pressure fuser apparatus comprising the fuser roll 74 and pressure roll 72 is illustrated together with a release agent management (RAM) system 90. As shown in FIG. 2, the fuser apparatus comprises the heated fuser roll 74 which is composed of a core 92 having thereon a layer or layers 94 of a suitable elastomer. The core 92 may be made of various metals such as iron, aluminum, nickel, stainless steel, etc., and various synthetic resins. Aluminum is preferred as the material for the core 92, although this is not critical. The core 92 is hollow and a heating element 96 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The fusing elastomer layer may be made of any of the well known materials such as the Viton and/or silicone rubber.

The fuser roll 74 is shown in a pressure contact arrangement with the backup or pressure roll 72. The pressure roll 72 comprises a metal core 98 with an outer layer 100 of a heat-resistant material. In this assembly, both the fuser roll 74 and the pressure roll 72 are mounted on bearings (not shown) which are biased so that the fuser roll 74 and pressure roll 72 are pressed against each other under sufficient pressure to form a nip 102. It is in this nip that the fusing or fixing action takes place. The layer 100 may be made of any of the well known materials such as Teflon a trademark of E.I. duPont.

The image receiving member or final support 25 having toner images 104 thereon is moved through the nip 102 with the toner images contacting the heated fuser roll 74. The toner material forming the image 104 is prevented from offsetting to the surface of the fuser roll 74 through the application of a release agent material such as silicone oil 106 contained in sump 108.

The sump 108 and silicone oil 106 form part of the RAM system 90. The RAM system 90, according to one embodiment of the invention, further comprises a metering roll 110 and a donor roll 112. The metering roll is supported partially immersed in the silicone oil 106 and contacts the donor roll for conveying silicone oil from the sump to the surface of the donor roll 112. The donor roll is rotatably supported in contact with the metering roll and also in contact with the fuser roll 94. While the donor roll is illustrated as contacting the fuser roll, it will be appreciated that, alternately, it may contact the pressure roll 72. Also, the positions of the fuser and pressure rolls may be reversed for use in other copiers or printers. A metering blade 114 supported in contact with the metering roll 110 serves to meter silicone oil to the required thickness on the metering roll.

Figure 3:
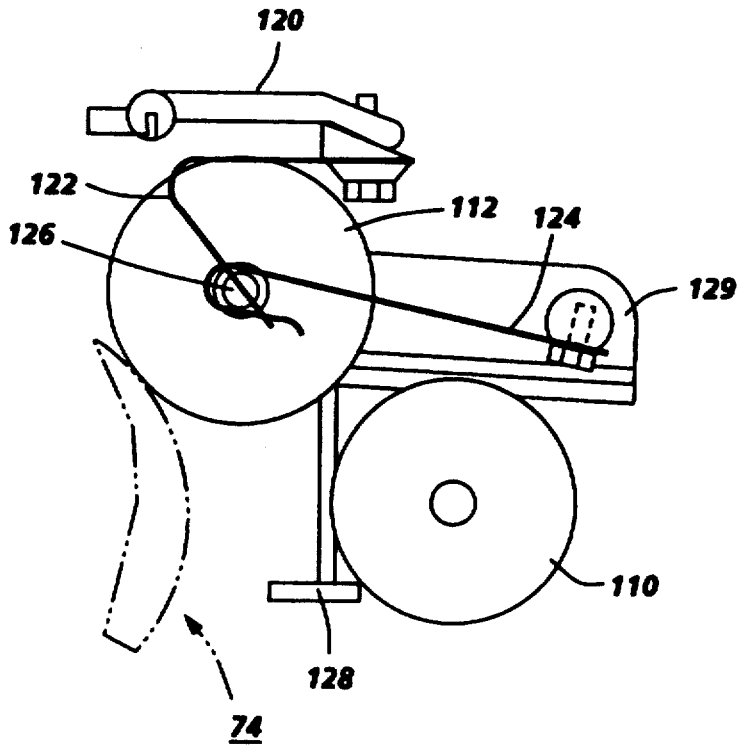
FIG. 3 a schematic illustration of a donor roll mounting structure depicting the donor roll in a pre-fusing position where it engages the fuser roll but does not engage with the metering roll.
Figure 4:
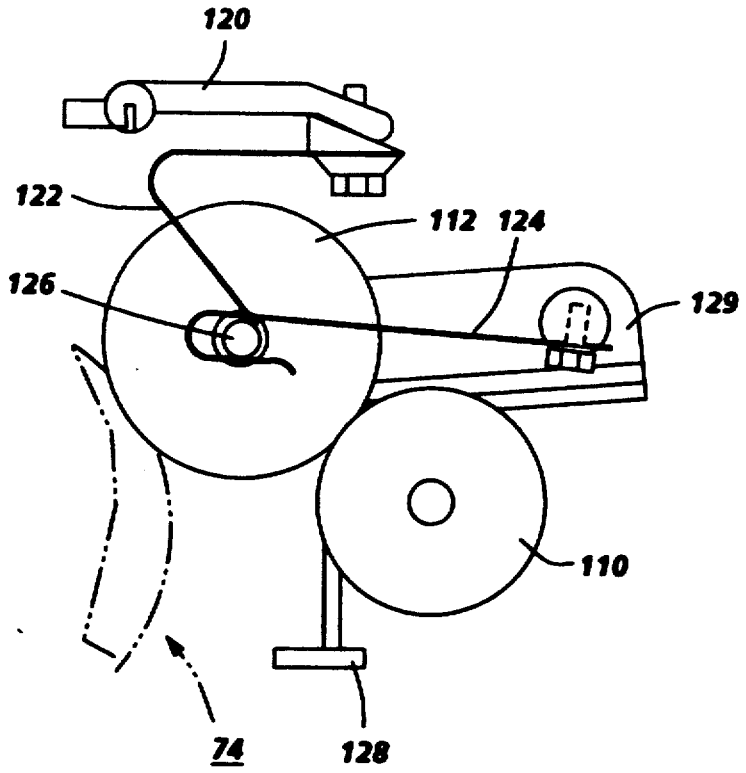
FIG. 4 is a schematic illustration of a donor roll mounting structure depicting the donor roll in a fusing position where it engages the metering roll of or the RAM system.

A cover member 120, only partially shown in FIGS. 3 and 4, is provided for the sump 108. The cover has attached to a bottom wall thereof, a pair of donor roll biasing members 122 (only one shown). The donor roll is supported, as shown in FIG. 3, by a pair of spring members 124 (only one shown) which are positioned adjacent the ends of the sump 108. To this end, the shaft ends 126 of the donor member are loosely received in the free ends of the springs 124. When the cover is installed the bias members 122 urge the donor roll against the user roll 74.

As can be seen from FIG. 3, the donor roll and the metering roll are disengaged from each other. This illustrates the orientation of the RAM members during the non-fusing or pre run mode. When the cover is installed on the sump the biasing members 122 serve to urge the donor roll against the fuser roll.

The springs 124 which are secured to a pivotally mounted bracket structure 129 are adapted for pivotal movement with the bracket structure in the counterclockwise direction as viewed in FIGS. 3 and 4 in order move the donor roll downwardly to effect engagement of the donor roll with the metering roll as illustrated in FIG. 4. Such engagement is effected through the movement of the bracket structure as it is cammed via a camming element 128 operatively connected to the bracket structure. The camming element 128 is a cam follower actuated by a cam, not shown. Camming action is initiated pursuant to the fusing of copies. The operative connection between the bracket and the cam follower 128 serves to allow pivoting of the bracket when the cam follower is moved in the downward direction.

What is claimed is:

1. Apparatus for applying offset preventing liquid to one member of a contact fuser for fixing powder images to a substrate, said apparatus comprising a supply of release agent material including a sump;

a release agent metering member supported for movement in an endless path and in contact with said supply of release agent material;

a donor member;

means for supporting said donor member;

means for urging said donor member against a heated fuser member during a first mode of operation and out of contact with said metering member; and means for moving said donor member for effecting engagement of said donor member with said metering member and said heated fuser member during a second mode of operation whereby said release agent material is supplied by said metering member directly from said sump to said donor member.

2. Apparatus according to claim 1 wherein said first mode of operation is a pre run mode.

3. Apparatus according to claim 2 wherein said second mode of operation comprises a run mode.

4. Apparatus according to claim 3 wherein urging means comprises bias means attached to a cover for said sump.

5. Apparatus according to claim 4 wherein said donor member comprises a roll supported on a shaft and said supporting means comprises a pair of spring members having means for loosely receiving the shaft ends of said donor member.

6. Apparatus according to claim 5 wherein said means for effecting engagement of said donor roll with said metering member comprise a cam structure.

7. Contact fuser apparatus, said apparatus comprising:

a first fuser member;

a second fuser member supported for engagement with said first fuser member to form a nip through which substrates carrying powder images pass;

means for elevating the temperature of at least one of said members;

a supply of release agent material including a sump;

a release agent metering member supported for movement in an endless path and in contact with said supply of release agent material;

a donor member;

means for supporting said donor member;

means for urging said donor member against a heated fuser member during a first mode of operation and out of contact with said metering member; and means for moving said donor member for effecting engagement of said donor member with said metering member and said heated fuser member during a second mode of operation whereby said release agent material is supplied by said metering member directly from said sump to said donor member.

8. Apparatus according to claim 7 wherein said first mode of operation is a pre run mode.

9. Apparatus according to claim 8 wherein said second mode of operation comprises a run mode.

10. Apparatus according to claim 9 wherein urging means comprises bias means attached to a cover for said sump.

11. Apparatus according to claim 10 wherein said donor member comprises a roll supported on a shaft and said supporting means comprises a pair of spring members having means for loosely receiving the shaft ends of said donor member.

12. Apparatus according to claim 11 wherein said means for effecting engagement of said donor roll with said metering member comprising a cam structure.

* * * * *